US009616972B2

(12) United States Patent
Lin et al.

(10) Patent No.: US 9,616,972 B2
(45) Date of Patent: Apr. 11, 2017

(54) ATTITUDE-ADAPTIVE HYDROFOIL APPARATUS FOR HIGH-SPEED UNDERWATER TOWING OPERATION

(71) Applicant: Dalian University of Technology, Dalian (CN)

(72) Inventors: Yan Lin, Dalian (CN); Yunlong Wang, Dalian (CN); Chaoguang Jin, Dalian (CN); Ming Chen, Dalian (CN); Guan Guan, Dalian (CN); Yanyun Yu, Dalian (CN); Kai Li, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 14/941,699

(22) Filed: Nov. 16, 2015

(65) Prior Publication Data

US 2016/0137263 A1 May 19, 2016

(30) Foreign Application Priority Data

Nov. 15, 2014 (CN) ..... 2014 1 0645906

(51) Int. Cl.
*B63B 1/28* (2006.01)
*B63B 1/24* (2006.01)
*B63B 21/66* (2006.01)

(52) U.S. Cl.
CPC ..... *B63B 1/242* (2013.01); *B63B 1/28* (2013.01); *B63B 21/66* (2013.01); *B63B 21/663* (2013.01); *B63B 2221/02* (2013.01)

(58) Field of Classification Search
CPC .... B63B 1/00; B63B 1/16; B63B 1/18; B63B 1/20; B63B 1/22; B63B 1/24; B63B 1/242; B63B 1/248; B63B 2001/00; B63B 2001/16; B63B 2001/18; B63B 2001/20; B63B 2001/24; B63B 2001/28; B63B 21/56;

(Continued)

(56) References Cited

U.S. PATENT DOCUMENTS 3,590,762 A * 7/1971 Yuan ..... B63B 1/288 114/275
4,055,138 A * 10/1977 Klein ..... B63B 21/66 114/244

(Continued)

*Primary Examiner* — Daniel V Venne
(74) *Attorney, Agent, or Firm* — Matthias Scholl, PC; Matthias Scholl

(57) ABSTRACT

An attitude-adaptive hydrofoil apparatus, including: strut-braced wing assemblies, a horizontal wing assembly, connection plates, and attack angle adjusting plates. The strut-braced wing assemblies each include a bearing, at least one inclined tube, at least one inclined flow-guiding wing, and at least one stop dog. The horizontal wing assembly includes a horizontal tube, at least one horizontal flow-guiding wing, and at least one depth-locating wing. The attack angle adjusting plates each include an angle adjusting end plate having a hole. The strut-braced wing assemblies are symmetrically disposed at two sides of the horizontal wing assembly. The bearing is fixed on a vessel body by welding. The at least one inclined flow-guiding wing is sleeved on the at least one inclined tube, and is limited by the at least one stop dog. The attack angle adjusting plates are disposed at two ends of the horizontal tube, respectively.

9 Claims, 6 Drawing Sheets

(58) Field of Classification Search
CPC ..... B63B 21/58; B63B 21/66; B63B 2021/56; B63B 2021/66; B63B 2021/666
USPC ..... 114/274, 278, 280, 282
See application file for complete search history.

(56) References Cited

U.S. PATENT DOCUMENTS 4,915,048 A * 4/1990 Stanford ..... B63B 1/30 114/274
8,171,872 B1 * 5/2012 Jenkins ..... B63B 1/285 114/315

* cited by examiner

ATTITUDE-ADAPTIVE HYDROFOIL APPARATUS FOR HIGH-SPEED UNDERWATER TOWING OPERATION

CROSS-REFERENCE TO RELATED APPLICATIONS

Pursuant to 35 U.S.C. §119 and the Paris Convention Treaty, this application claims the benefit of Chinese Patent Application No. 201410645906.9 filed Nov. 15, 2014, the contents of which are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to an attitude-adaptive hydrofoil apparatus for high-speed underwater towing operation.

Description of the Related Art

Typically, hydrofoil apparatus is fixed on the rear of a vessel, so that the attitude and depth thereof cannot be adjusted. When the vessel sails at high speed or encounters harsh marine environment, the running resistance is considerably large, and the vessel and the hydrofoil apparatus easily become damaged.

SUMMARY OF THE INVENTION

In view of the above-described problems, it is one objective of the invention to provide an attitude-adaptive hydrofoil apparatus for high-speed underwater towing operation. The hydrofoil apparatus can actively adjust its running attitude according to navigational status and surrounding environments, so as to maintain the running stability and a certain operating depth thereof.

To achieve the above objective, in accordance with one embodiment of the invention, there is provided an attitude-adaptive hydrofoil apparatus for high-speed underwater towing operation. The hydrofoil apparatus comprises: strut-braced wing assemblies, a horizontal wing assembly, connection plates, and attack angle adjusting plates. The strut-braced wing assemblies each comprise a bearing, at least one inclined tube, at least one inclined flow-guiding wing, and at least one stop dog. The horizontal wing assembly comprises a horizontal tube, at least one horizontal flow-guiding wing, and at least one depth-locating wing. The attack angle adjusting plates each comprise an angle adjusting end plate having a hole. The strut-braced wing assemblies are symmetrically disposed at two sides of the horizontal wing assembly. The bearing is fixed on a vessel body by welding. The at least one inclined flow-guiding wing is sleeved on the at least one inclined tube, and is limited by the at least one stop dog. The at least one inclined tube comprises a first ear plate, and the era plate is connected to the bearing via an anchor shackle and an anchor swivel; a lower end of the at least one inclined tube is connected to the horizontal wing assembly via the connection plates and the attack angle adjusting plates. The at least one horizontal flow-guiding wing and at least one depth-locating wing are sleeved on the horizontal tube. The attack angle adjusting plates are disposed at two ends of the horizontal tube, respectively; an angle adjustment bolt is inserted into the hole of the angle adjusting end plate and is fixed by an angle adjustment nut; and an attack angle of the at least one depth-locating wing is determined by the at least one inclined tube, the angle adjustment bolt, and the angle adjustment nut.

In a class of this embodiment, the bearing and the first ear plate each are provided with a hole to connect to the anchor shackle.

In a class of this embodiment, the anchor shackle comprises an upper anchor shackle and a lower anchor shackle, and the upper anchor shackle and the lower anchor shackle are connected via the anchor swivel; the anchor swivel is at least one in number.

In a class of this embodiment, the at least one inclined flow-guiding wing comprises an upper inclined flow-guiding wing and a lower inclined flow-guiding wing which are provided with round holes and sleeved on the at least one inclined tube; the upper inclined flow-guiding wing and the lower inclined flow-guiding wing are adapted to rotate freely.

In a class of this embodiment, the at least one stop dog comprises an upper stop dog and a lower stop dog, and two ends of the at least one inclined tube is limited by the upper stop dog and the lower stop dog, respectively.

In a class of this embodiment, the connection plates each is connected to the at least one inclined tube via a knee plate, and a second ear plate comprising a round hole is disposed at a lower end of each of the connection plates.

In a class of this embodiment, a third ear plate and the angle adjusting end plate are disposed at an upper end and a lower end of the attack angle adjusting plates, respectively; the third ear plate is provided with a round hole, and a bolt inserts into the round holes of the second ear plate and the third ear plate and is fixed by a nut, so that the connection plates and the attack angle adjusting plates are fixedly connected.

In a class of this embodiment, the angle adjustment nut is adapted to adjust a location of the angle adjustment bolt to adjust a magnitude of the attack angle of the at least one depth-locating wing.

In a class of this embodiment, the at least one horizontal flow-guiding wing and the at least one depth-locating wing are provided with round holes; two ends of the horizontal tube are provided with external screw threads, so that the attack angle adjusting plates are fixed on the horizontal tube by a fixed nut.

Advantages of the attitude-adaptive hydrofoil apparatus for high-speed underwater towing operation are summarized as follows. The attitude-adaptive hydrofoil apparatus comprises the strut-braced wing assemblies and the horizontal wing assembly. The strut-braced wing assemblies are symmetrically disposed at two sides of the horizontal wing assembly, and the whole structure of the attitude-adaptive hydrofoil apparatus is U-shaped. The strut-braced wing assemblies and the horizontal wing assembly are flexibly connected to the vessel body, so, compared to a conventional hydrofoil, the stresses are moderate. The inclined flow-guiding wing is sleeved on the inclined tube and can rotate freely, which greatly reduces the running resistance and the vortex induced vibration of the hydrofoil apparatus, thus ensuring the security and stability of the hydrofoil apparatus. Likewise, the horizontal flow-guiding wing and the depth-locating wing are sleeved on the horizontal tube, and the attack angle of the depth-locating wing is determined by the angle adjustment nut. When the vessel sails at a certain speed, the depth-locating wing generates a sinking force, so that the hydrofoil apparatus stays a certain depth. In addition, the bilateral symmetric structure of the hydrofoil apparatus is favorable for the hydrofoil apparatus to automatically adjust operating attitude and maintain a horizontal state. The hydrofoil apparatus has simple structure, convenient and safe operation, high practicability, and is very practicable for high-speed underwater towing operation.

BRIEF DESCRIPTION OF THE DRAWINGS

The invention is described hereinbelow with reference to the accompanying drawings, in which.

Figure 1:
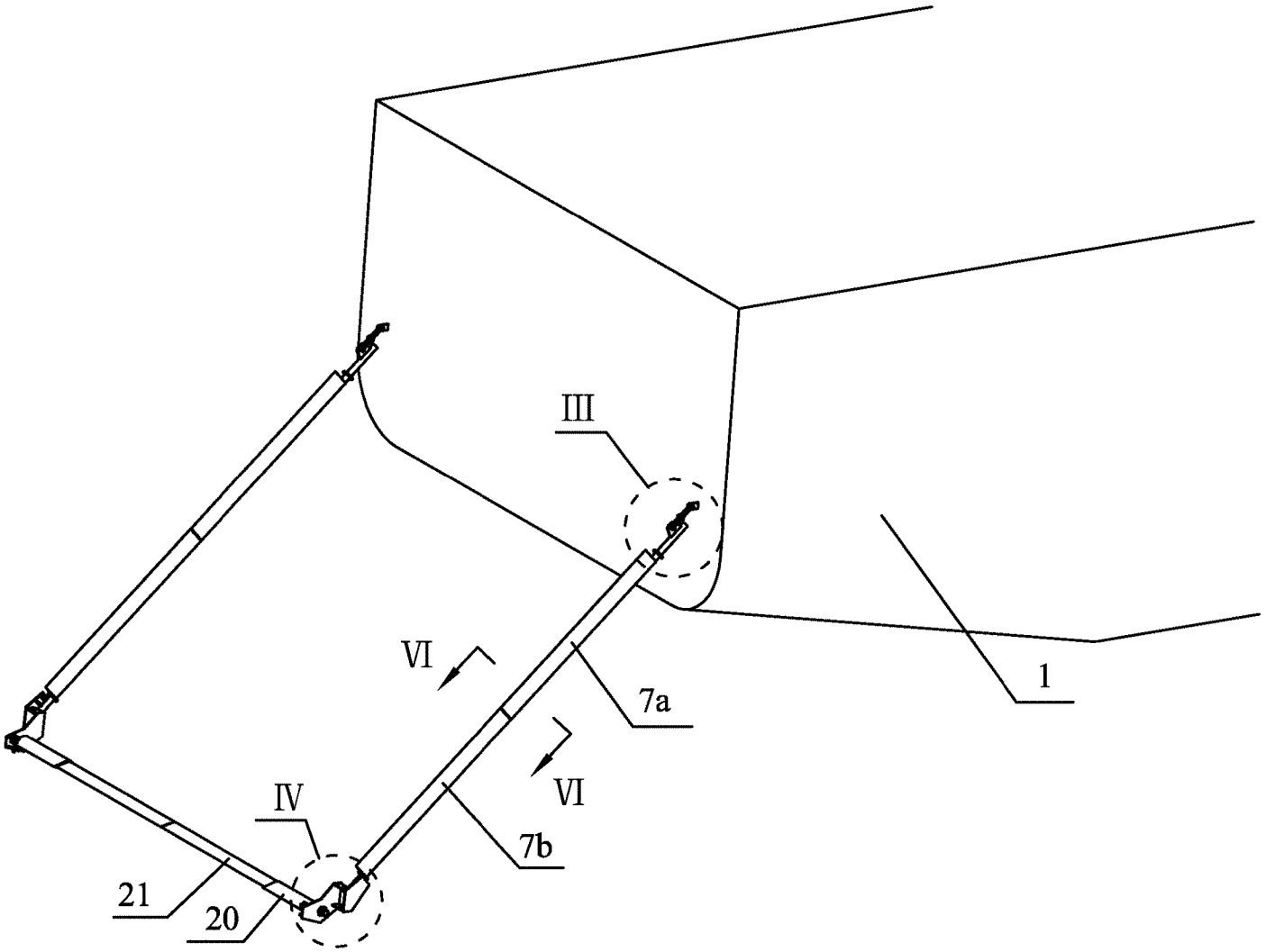
FIG. 1 is a stereograph of an attitude-adaptive hydrofoil apparatus for high-speed underwater towing operation according to one embodiment of the invention.

In the drawings, the following reference numbers are used:

1. Vessel body;
2. Bearing;
3*a*. Upper anchor shackle;
3*b*. Lower anchor shackle;
4. Anchor swivel;
5. First ear plate;
6. Inclined tube;
7*a*. Upper inclined flow-guiding wing;
7*b*. Lower inclined flow-guiding wing;
8*a*. Upper stop dog;
8*b*. Lower stop dog;
9. Connection plate;
10*a*. Upper knee plate;
10*b*. Lower knee plate;
11*a*. Upper second ear plate;
11*b*. Lower second ear plate;
12. Bolt;
13. Nut;
14. Attack angle adjusting plate;
15. Third ear plate;
16. Angle adjusting end plate;
17. Angle adjustment bolt;
18. Angle adjustment nut;
19. Horizontal tube;
20. Depth-locating wing;
21. Horizontal flow-guiding wing;
22. Fixed nut.

DETAILED DESCRIPTION OF THE EMBODIMENTS

For further illustrating the invention, experiments detailing an attitude-adaptive hydrofoil apparatus for high-speed underwater towing operation are described below. It should be noted that the following examples are intended to describe and not to limit the invention.

Figure 2:
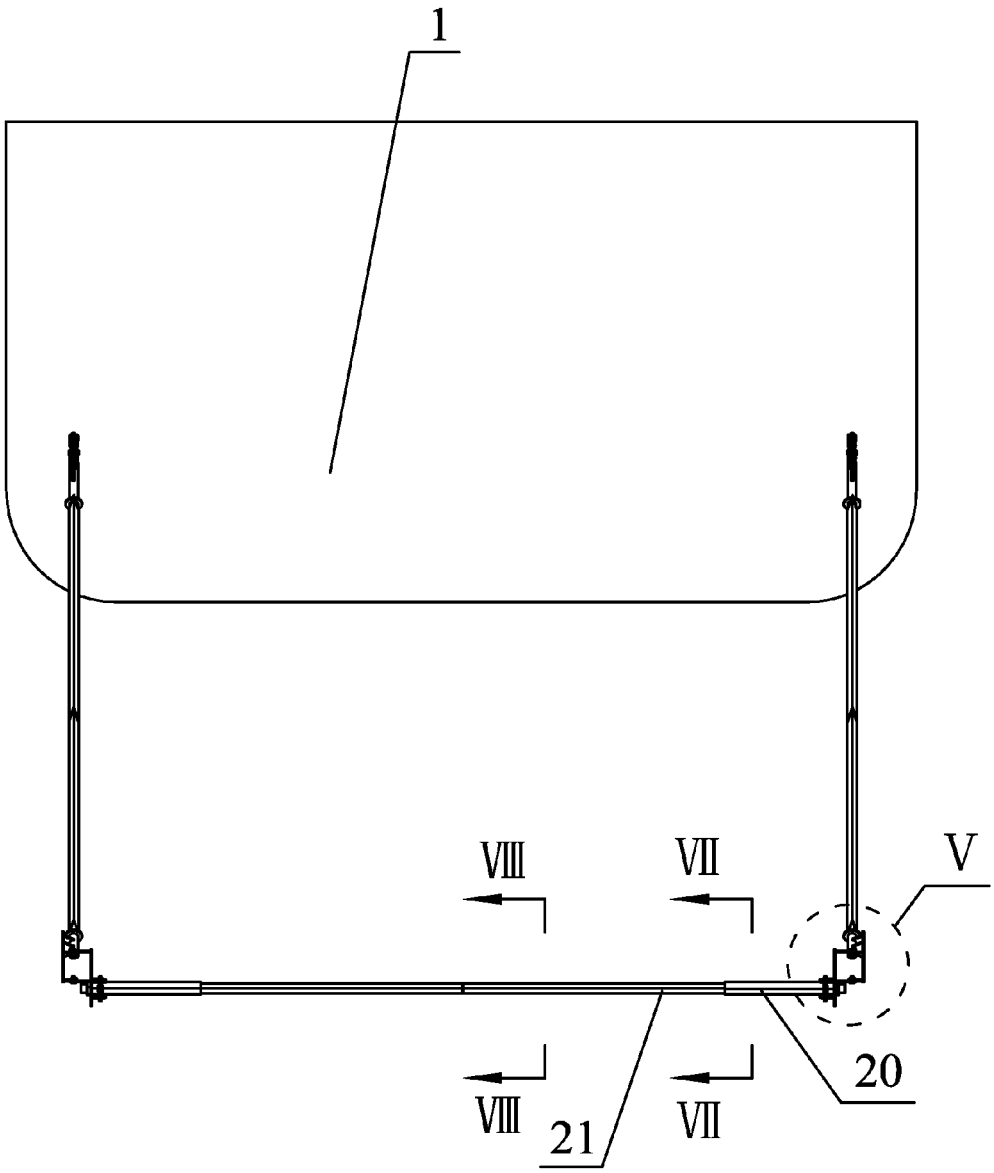
FIG. 2 is a front view of an attitude-adaptive hydrofoil apparatus for high-speed underwater towing operation according to one embodiment of the invention.

FIGS. 1-2 are a stereograph and a front view of an attitude-adaptive hydrofoil apparatus for high-speed underwater towing operation of the invention, respectively. The attitude-adaptive hydrofoil apparatus comprises strut-braced wing assemblies and a horizontal wing assembly. The strut-braced wing assemblies are symmetrically disposed at two sides of the horizontal wing assembly, and the whole structure of the attitude-adaptive hydrofoil apparatus is U-shaped. The strut-braced wing assemblies each comprise a bearing 2, at least one inclined tube 6, at least one inclined flow-guiding wing, and at least one stop dog. The horizontal wing assembly comprises a horizontal tube 19, at least one horizontal flow-guiding wing 21, and at least one depth-locating wing 20. The bearing 2 is fixed on a vessel body by welding, and is connected to the inclined tube 6 via an anchor shackle and an anchor swivel 4. The inclined tube 6 is connected to the horizontal tube 19 via attack angle adjusting plates 14. The at least one inclined flow-guiding wing is sleeved on the at least one inclined tube 6. The at least one horizontal flow-guiding wing 21 and at least one depth-locating wing 20 are sleeved on the horizontal tube 19.

Figure 3:
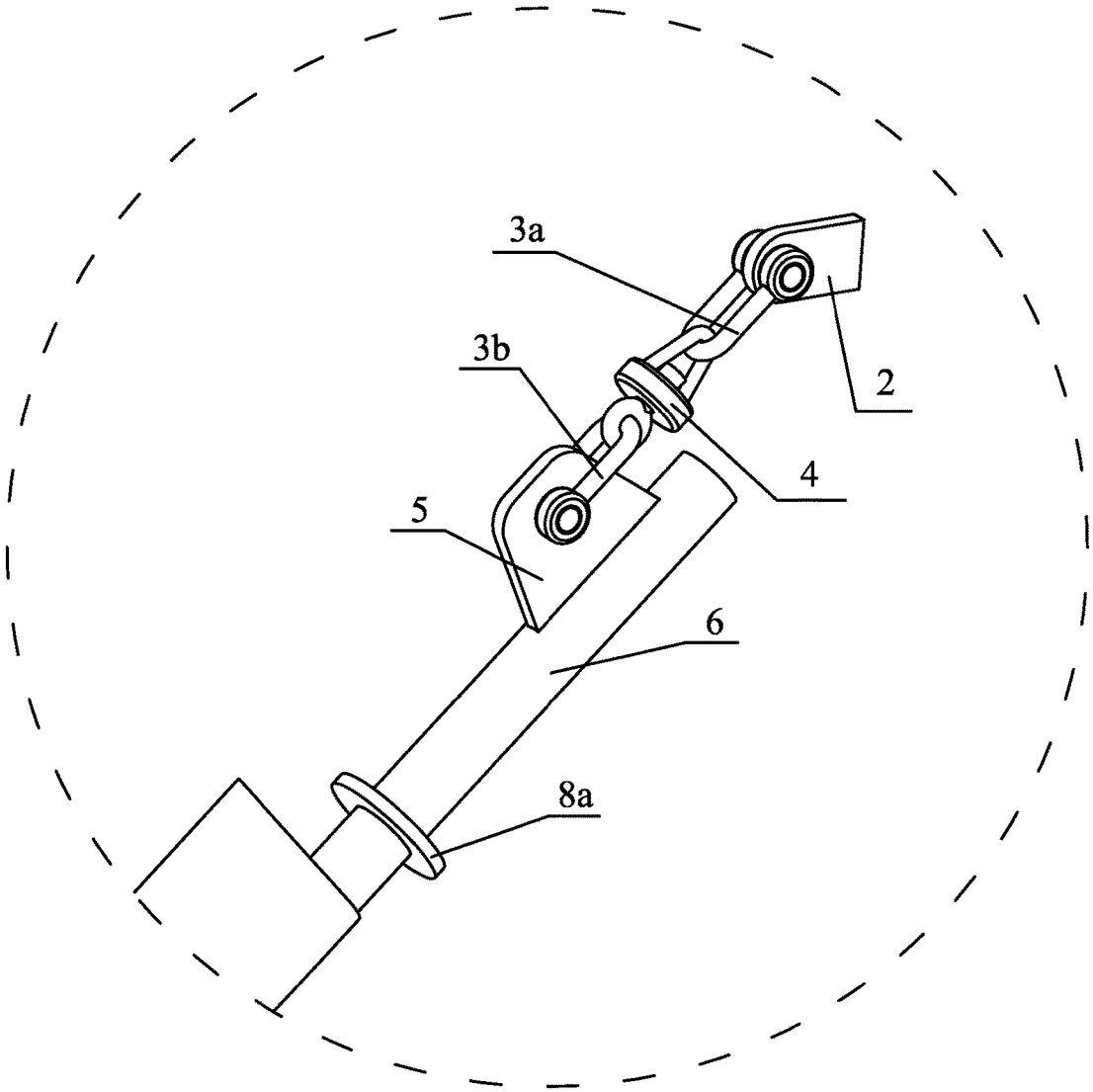
FIG. 3 is an enlarged view of part III of FIG. 1.

FIG. 3 shows the connection of a vessel body 1 and the strut-braced wing assemblies. The bearing 2 is welded to the tail of the vessel body 1, and the first ear plate 5 is welded on the upper end of the inclined tube 6. The bearing 2 and the first ear plate 5 each are provided with a hole to connect to the upper anchor shackle 3*a* and the lower anchor shackle 3*b*, respectively. The upper anchor shackle 3*a* and the lower anchor shackle 3*b* are connected via the anchor swivel 4. The at least one inclined flow-guiding wing 7 is sleeved on the at least one inclined tube 6, and the upper end thereof is limited by the upper stop dog 8*a*.

Figure 4:
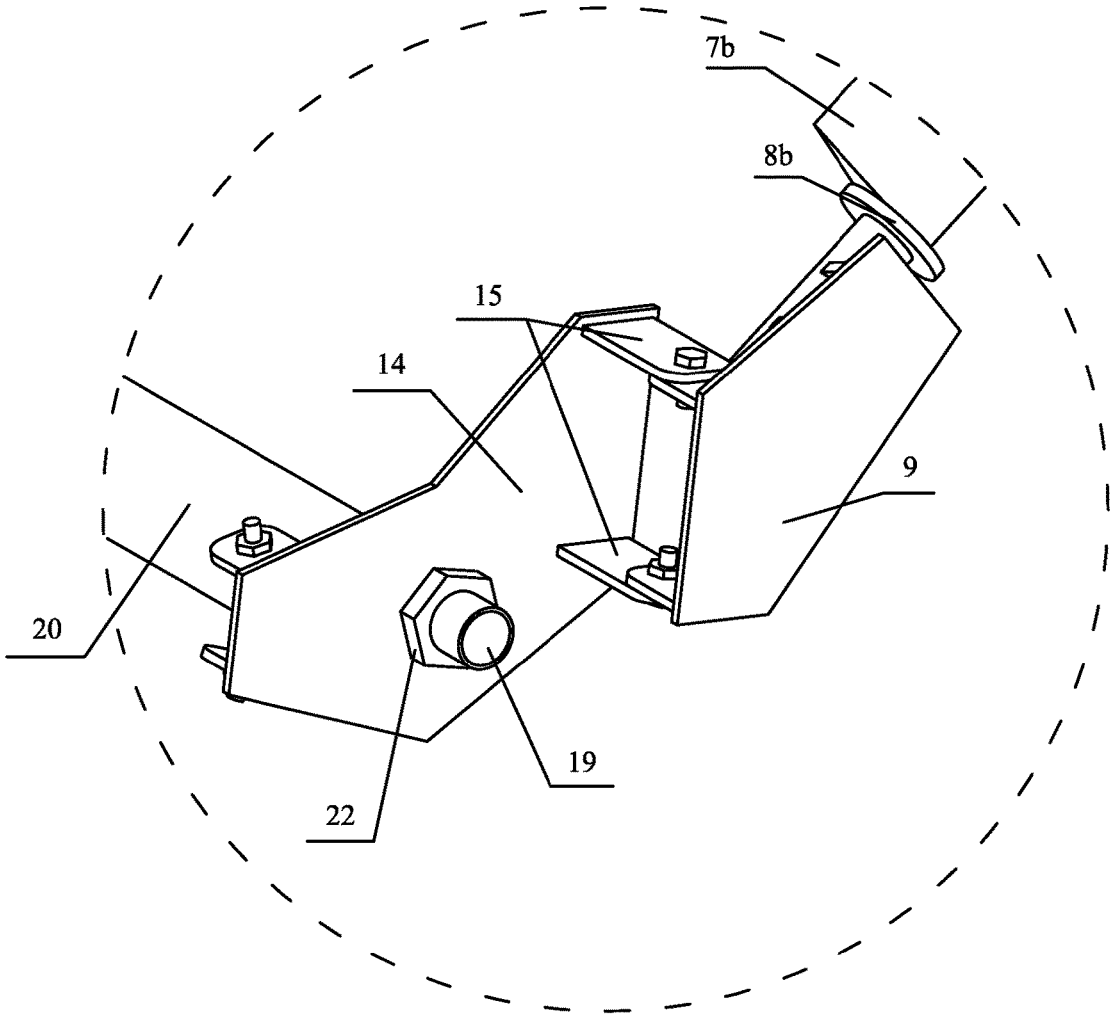
FIG. 4 is an enlarged view of part IV of FIG. 1.
Figure 5:
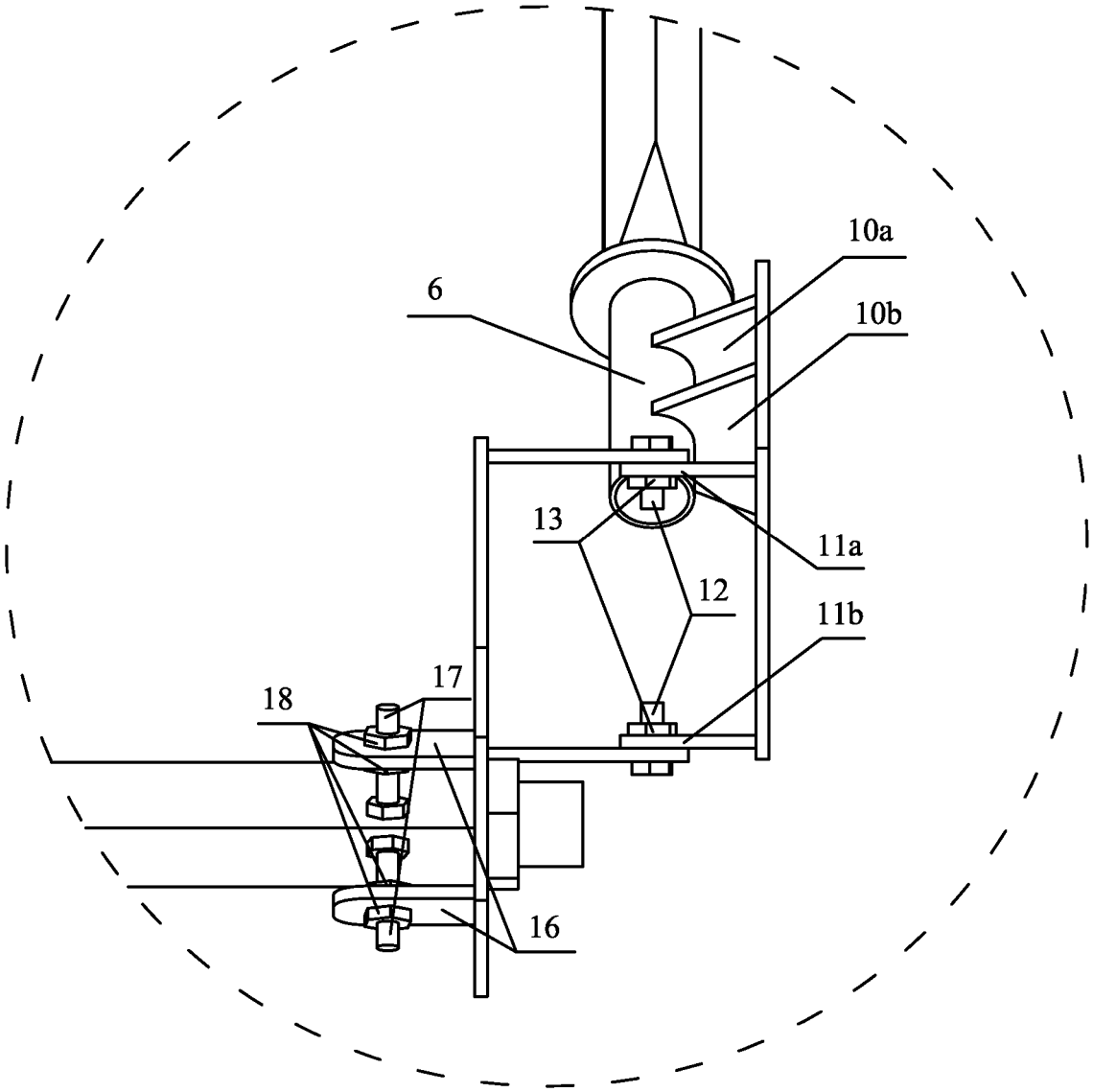
FIG. 5 is an enlarged view of part V of FIG. 1.

FIGS. 4-5 show the connection of the strut-braced wing assemblies and the horizontal wing assembly. The connection plates 9 comprise an upper second ear plate 11*a* and a lower second ear plate 11*b* both comprising round holes. The upper second ear plate 11*a* and the lower second ear plate 11*b* are fixed on the inclined tube 6 via an upper knee plate 10*a* and a lower knee plate 10*b*, respectively. A third ear plate 15 having a round hole and the angle adjusting end plate 16 having a round hole are disposed at an upper end and a lower end of the attack angle adjusting plates 14. Two ends of the horizontal tube 19 are provided with external screw threads. The two ends of the horizontal tube 19 pass through the round holes of the attack angle adjusting plates 14 and are fixed by a fixed nut 22. The third ear plate 15 is provided with a round hole, and a bolt 12 inserts into the round holes of the second ear plate and the third ear plate 15 and is fixed by a nut 13, so that the connection plates 9 and the attack angle adjusting plates 14 are fixedly connected. The angle adjusting end plate 16 comprises a hole, and an angle adjustment bolt 17 is inserted into the hole of the angle adjusting end plate 16 and is fixed by an angle adjustment nut 18. Four angle adjustment nuts 18 can lock the position of the angle adjustment bolt 17, so as to determine the position of the depth-locating wing 20.

Figure 6:
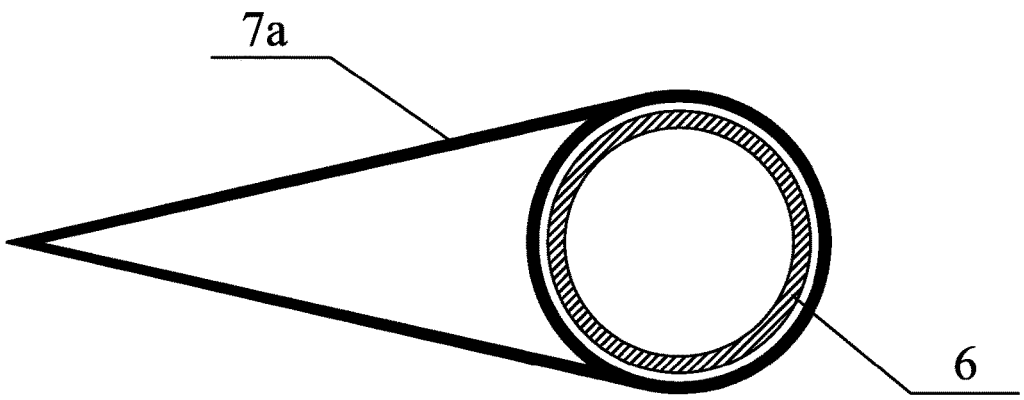
FIG. 6 is a cross sectional view of FIG. 1 taken from line VI-VI.

FIG. 6 is a schematic diagram showing the upper inclined flow-guiding wing 7*a* is sleeved on the inclined tube 6.

Figure 7:
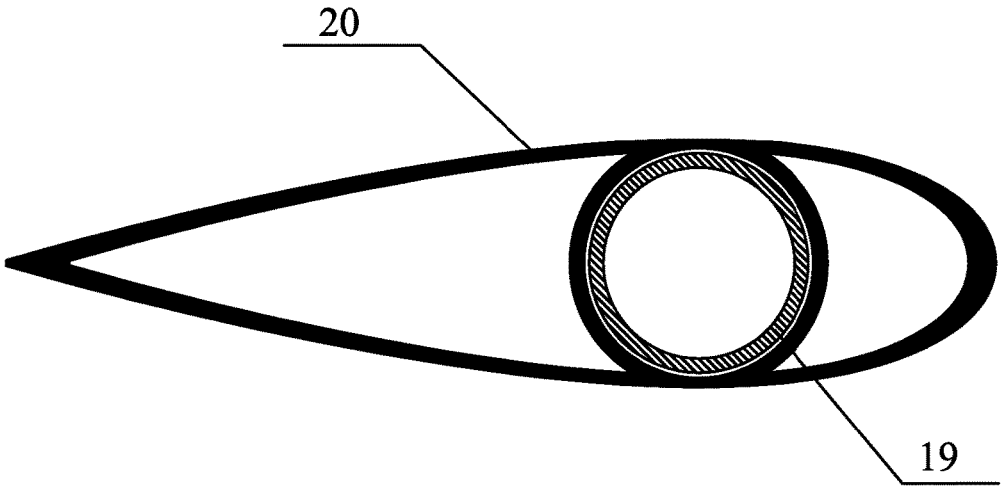
FIG. 7 is a cross sectional view of FIG. 2 taken from line VII-VII.

FIG. 7 is a schematic diagram showing the depth-locating wing 20 is sleeved on the horizontal tube 19.

Figure 8:
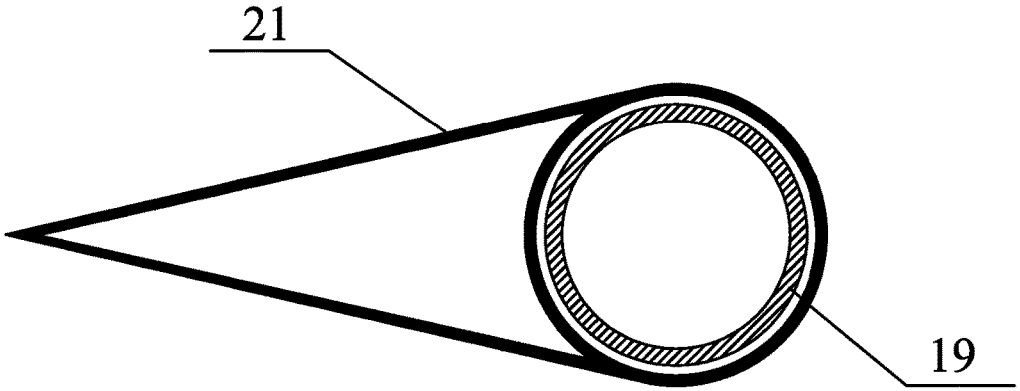
FIG. 8 is a cross sectional view of FIG. 2 taken from line VIII-VIII.

FIG. 8 is a schematic diagram showing the horizontal flow-guiding wing 21 is sleeved on the horizontal tube 19.

Prior to submergence, the angle adjustment nut 18 is adjusted to adjust the attack angle of the depth-locating wing 20 of the hydrofoil apparatus. In the water, the hydrofoil apparatus can actively adjust its running attitude according to navigational status and surrounding environments, so as to maintain the running stability and a certain operating depth thereof. So, the hydrofoil apparatus provides a good working platform for marine survey and marine experiments.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A hydrofoil apparatus, comprising:

a) strut-braced wing assemblies, the strut-braced wing assemblies each comprising a bearing, at least one inclined tube, at least one inclined flow-guiding wing, and at least one stop dog;

b) a horizontal wing assembly, the horizontal wing assembly comprising a horizontal tube, at least one horizontal flow-guiding wing, and at least one depth-locating wing;

c) connection plates; and d) attack angle adjusting plates, the attack angle adjusting plates each comprising an angle adjusting end plate having a hole;

wherein:

the strut-braced wing assemblies are symmetrically disposed at two sides of the horizontal wing assembly;

the bearing is fixed on a vessel body by welding;

the at least one inclined flow-guiding wing is sleeved on the at least one inclined tube, and the at least one stop dog is disposed on the at least one inclined tube; wherein the at least one stop dog protrudes from the at least one inclined tube and is adapted to block the at least one inclined flow-guiding wing;

the at least one inclined tube comprises a first ear plate, and the first ear plate is connected to the bearing via an anchor shackle and an anchor swivel;

a lower end of the at least one inclined tube is connected to the horizontal wing assembly via the connection plates and the attack angle adjusting plates;

the at least one horizontal flow-guiding wing and at least one depth-locating wing are sleeved on the horizontal tube;

the attack angle adjusting plates is disposed at two ends of the horizontal tube, respectively;

an angle adjustment bolt is inserted into the hole of the angle adjusting end plate and is fixed by an angle adjustment nut; and the angle adjustment bolt is adapted to adjust an attack angle of the at least one depth-locating wing.

2. The hydrofoil apparatus of claim 1, wherein the bearing and the first ear plate each are provided with a hole to connect to the anchor shackle.

3. The hydrofoil apparatus of claim 1, wherein the anchor shackle comprises an upper anchor shackle and a lower anchor shackle, and the upper anchor shackle and the lower anchor shackle are connected via the anchor swivel; the anchor swivel is at least one in number.

4. The hydrofoil apparatus of claim 1, wherein the at least one inclined flow-guiding wing comprises an upper inclined flow-guiding wing and a lower inclined flow-guiding wing which are provided with round holes and sleeved on the at least one inclined tube; the upper inclined flow-guiding wing and the lower inclined flow-guiding wing are adapted to rotate freely.

5. The hydrofoil apparatus of claim 1, wherein the at least one stop dog comprises an upper stop dog and a lower stop dog, and the upper stop dog and the lower stop dog are disposed on two ends of the at least one inclined tube, respectively.

6. The hydrofoil apparatus of claim 1, wherein the connection plates each is connected to the at least one inclined tube via an upper knee plate and a lower knee plate, and a lower end of each of the connection plates is provided with an upper second ear plate and a lower second ear plate; the upper second ear plate comprising a first round hole and the lower second ear plate comprising a second round hole.

7. The hydrofoil apparatus of claim 6, wherein a third ear plate and the angle adjusting end plate are disposed at an upper end and a lower end of the attack angle adjusting plates, respectively; the third ear plate is provided with a third round hole and a fourth round hole; a first bolt inserts into the first round hole of the upper second ear plate and the third round hole of the third ear plate and is fixed by a first nut, and a second bolt inserts into the second round hole of the lower second ear plate and the fourth round hole of the third ear plate and is fixed by a second nut, so that the connection plates and the attack angle adjusting plates are fixedly connected.

8. The hydrofoil apparatus of claim 1, wherein the angle adjustment nut is adapted to adjust a location of the angle adjustment bolt and then to adjust a magnitude of the attack angle of the at least one depth-locating wing.

9. The hydrofoil apparatus of claim 1, wherein the at least one horizontal flow-guiding wing and the at least one depth-locating wing are provided with round holes at two ends thereof; two ends of the horizontal tube are provided with external screw threads, so that the attack angle adjusting plates are fixed on the horizontal tube by a fixed nut.

* * * * *